US009389038B1

(12) United States Patent
Leavitt

(10) Patent No.: US 9,389,038 B1
(45) Date of Patent: Jul. 12, 2016

(54) ROTATABLE TURRET AND WEAPON SYSTEM

(71) Applicant: Dillon Aero Inc., Scottsdale, AZ (US)

(72) Inventor: Michael Leavitt, Scottsdale, AZ (US)

(73) Assignee: Dillon Aero, Inc., Scottsdale, AZ (US)

( * ) Notice: Subject to any disclaimer, the term of this patent is extended or adjusted under 35 U.S.C. 154(b) by 0 days.

(21) Appl. No.: 14/276,455

(22) Filed: May 13, 2014

Related U.S. Application Data

(60) Provisional application No. 61/822,602, filed on May 13, 2013.

(51) Int. Cl.
*F41A 23/24* (2006.01)

(52) U.S. Cl.
CPC ..... *F41A 23/24* (2013.01)

(58) Field of Classification Search
CPC ..... F41A 23/24; F41A 9/00
USPC ..... 89/37.1–37.03, 37.12, 40.03
See application file for complete search history.

(56) References Cited

U.S. PATENT DOCUMENTS 607,681 A * 7/1898 Cochrane ..... F41A 27/06 89/33.1
1,800,276 A 4/1931 Baker
2,344,566 A 3/1944 Selman
2,441,874 A 5/1948 Evans
3,333,507 A 8/1967 Meiss
3,721,156 A 3/1973 Schallehn
4,667,565 A 5/1987 Anderson
4,951,548 A * 8/1990 Wixon ..... F41A 9/34 89/33.14
5,095,803 A * 3/1992 Allais ..... F41A 23/24 89/37.07
5,353,680 A 10/1994 Tiomkin et al.
7,175,233 B2 2/2007 Greenwood et al.
8,146,992 B2 4/2012 Brown et al.

FOREIGN PATENT DOCUMENTS

DE 2654819 A1 * 5/1991 ..... F41A 23/24

* cited by examiner

*Primary Examiner* — Reginald Tillman, Jr.
(74) *Attorney, Agent, or Firm* — James L Farmer

(57) ABSTRACT

Designs and methods are provided for a rotatable turret and weapon system. In one exemplary embodiment the system comprises a rotatable turret ring atop a gunner station in a supporting structure, and a gun mount at a first location on the turret ring adapted for mounting an automatic weapon accessible to a gunner. An ammunition mount adapted to interchangeably secure an ammunition magazine, or an adapter for holding multiple ammunition magazines, to the turret ring at a second location. The ammunition mount, gun mount, and turret ring move as an integral unit.

14 Claims, 8 Drawing Sheets

ROTATABLE TURRET AND WEAPON SYSTEM

Provisional Patent Application Ser. No. 61/822,602, to which the present application claims priority, is hereby incorporated by reference.

TECHNICAL FIELD

The technical field of the present invention generally relates to rotatable weapon turrets, including for example vehicle mounted weapon turrets designed for a standing gunner operating a pivotally mounted machine gun.

DESCRIPTION OF THE EMBODIMENTS

Figure 1:
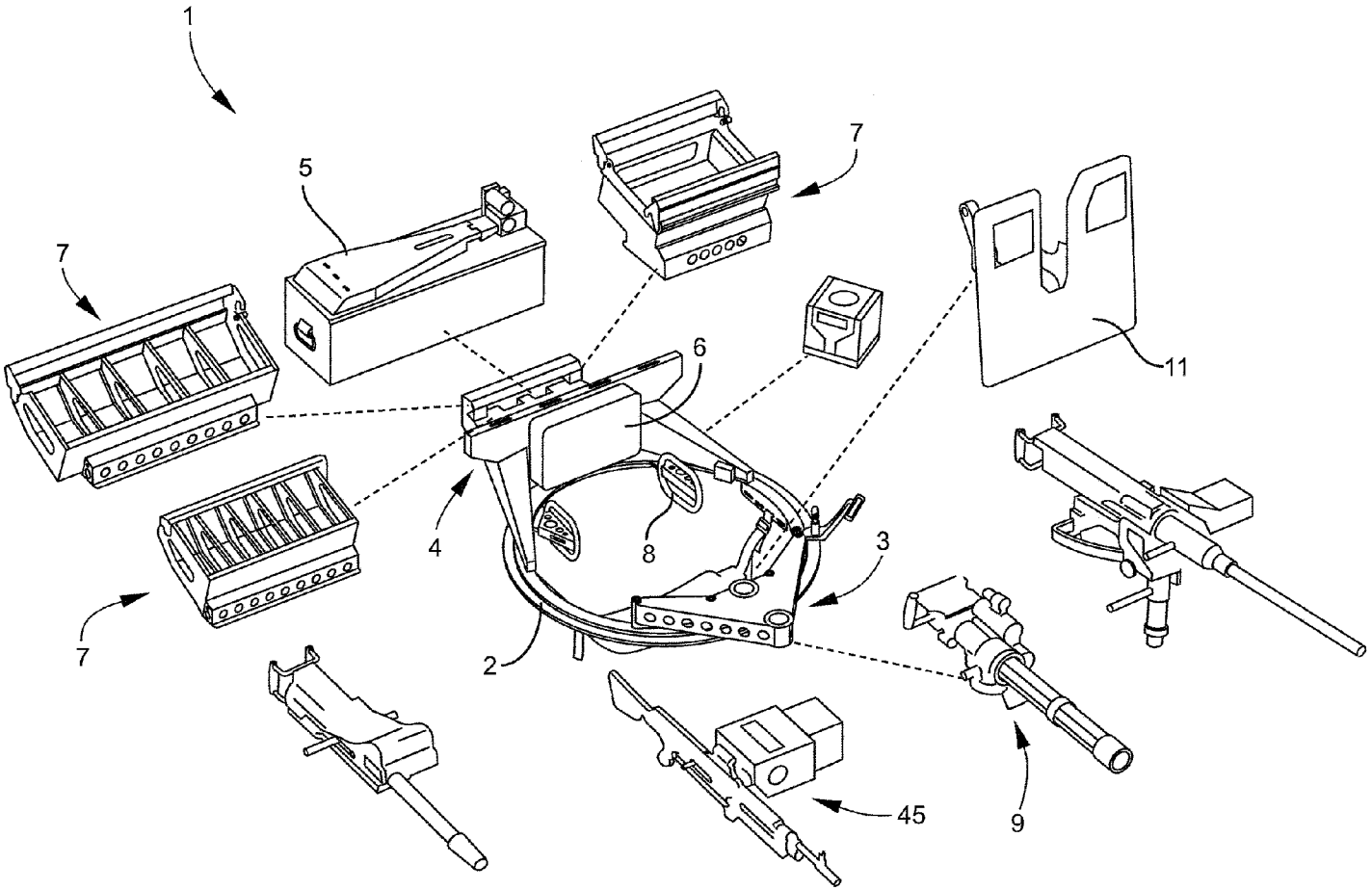
FIG. 1 is an exploded perspective of an exemplary rotatable turret and weapon system in accordance with the present disclosure, including various weapons, ammunition magazines, ammunition magazine holders, and other attachable components.

The instant invention is described more fully hereinafter with reference to the accompanying drawings and/or photographs, in which one or more exemplary embodiments of the invention are shown. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Referring now to the drawing Figures, an exemplary rotatable turret 1 for use by a standing gunner comprises generally a rotatable turret ring 2 with features such as a gunner backrest 6 and lateral restraints 8; a gun mount 3 mounted to ring 2 in front of the gunner; and a versatile ammunition mount 4 on ring 2 behind the gunner. The turret ring 2 is essentially a rigid circular ring mounted on bearings for unrestricted 360 degree rotation about a central axis. Ring 2 is adapted with suitable flanges or holes for attaching the turret 1 to an opening atop a gunner station in a supporting structure. Such structures may include for example ground vehicles, aircraft, helicopters, watercraft, bunkers, and various dwelling structures. Turret ring 2 is designed with sufficient load capacity to carry the weight of the gun mount 3 with a machine gun installed, ammunition mount 4 holding one or more ammunition boxes, along with various other components to be described herein, without overloading the turret bearings or interfering with the free rotation of the ring.

Figure 2:
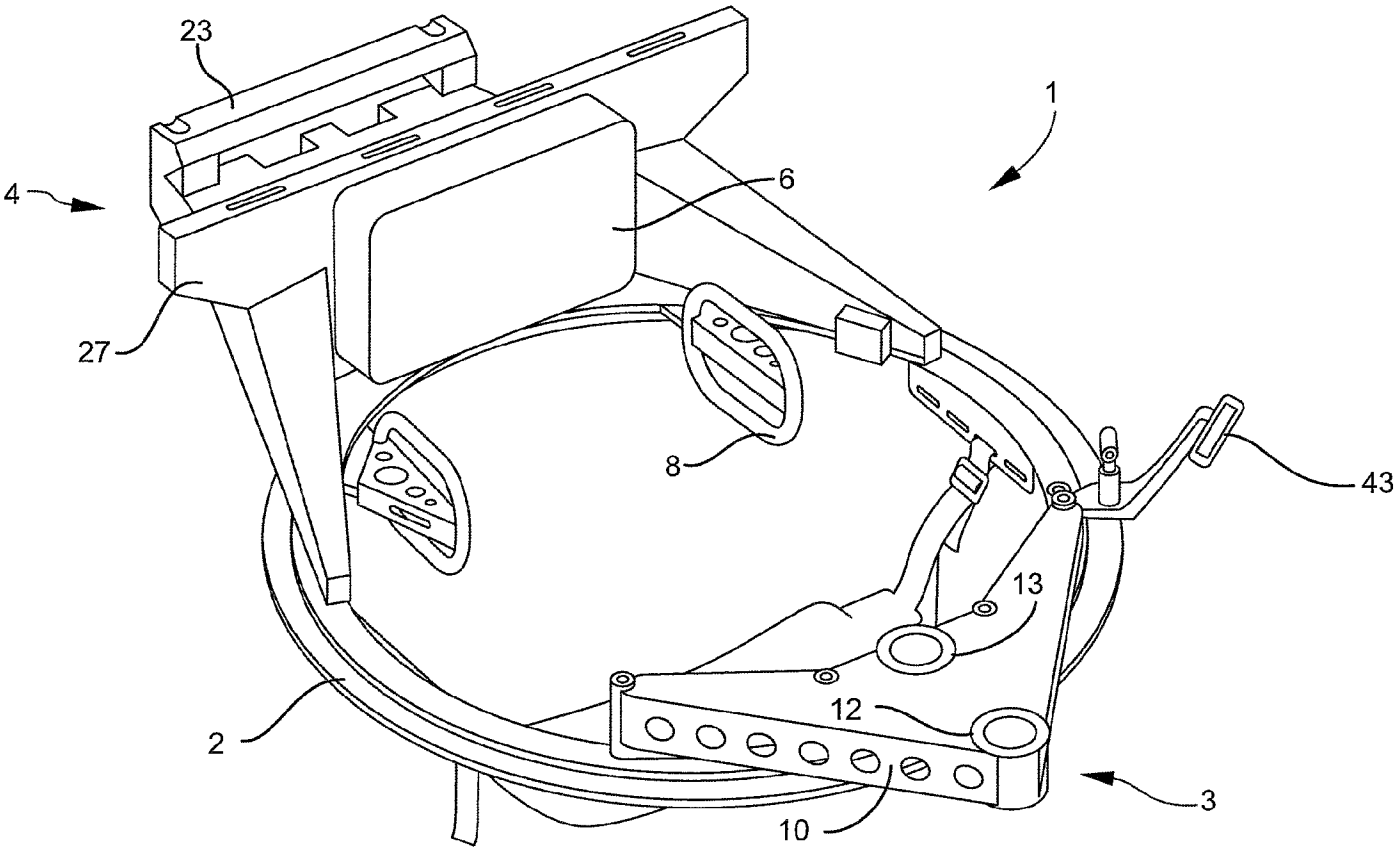
FIG. 2 is a perspective view of the rotatable turret and weapon system of FIG. 1, comprising a rotatable turret ring, an integral gun mount, and integral ammunition mount.
Figure 3:
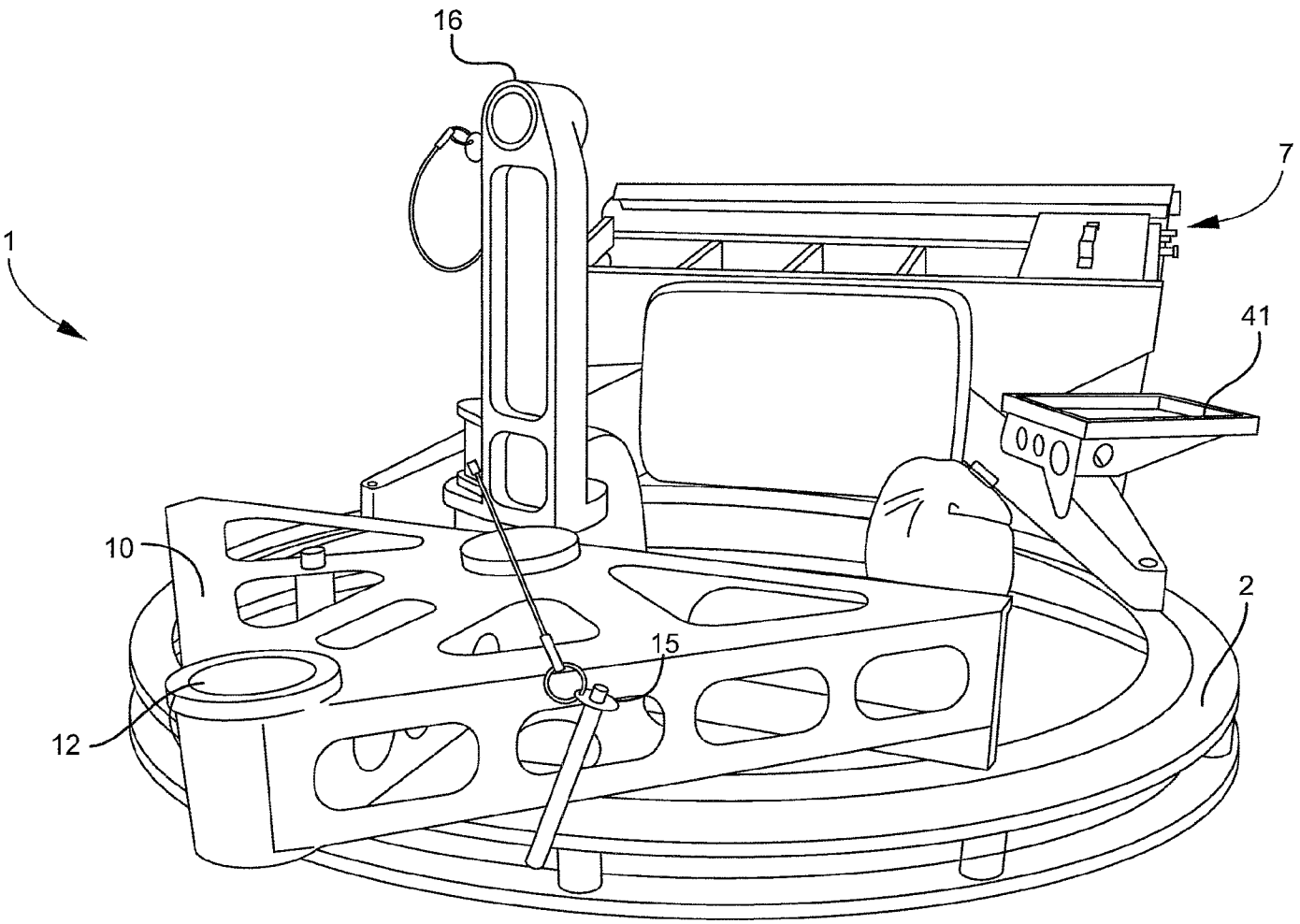
FIG. 3 is another perspective view of the turret and weapon system of FIG. 2, with an ammunition storage cradle and battery tray supported by the ammunition mount.

Gun mount 3 and ammunition mount 4 are attached to turret ring 2 and thus rotate with it. Referring to FIGS. 2 and 3, the gun mount 3 comprises essentially a large bracket 10 with front and back gun mount sockets 12, 13, located in a center of portion of the bracket. The sockets 12, 13, may be identical or not, and may be adapted to receive dimensionally standardized mounting posts, such as for example the depicted post 16, commonly used for pivotal mounting of machine guns and other weapons. Various such mountable machine guns are shown in FIG. 1, including for example a representation of the U.S. Army's electrically powered M134 gatling gun indicated at reference numeral 9. The physical dimensions and design of the gun, among other considerations, may factor into determining which socket is preferable in a given situation. In addition, although two gun sockets are shown, the turret contemplated by the present disclosure may instead have three or more sockets, or only one socket. A gun mount post may be locked in the socket, for example by inserting a locking pin 15 through holes in the post and socket that align when the socket is properly installed. The locking pin may be self retaining with a quick release button such as the type shown in FIG. 3. Sockets 12, 13 may also be utilized to attach other accessories to the gun mount, such as the ballistic shield 11 shown in FIG. 1.

Figure 4:
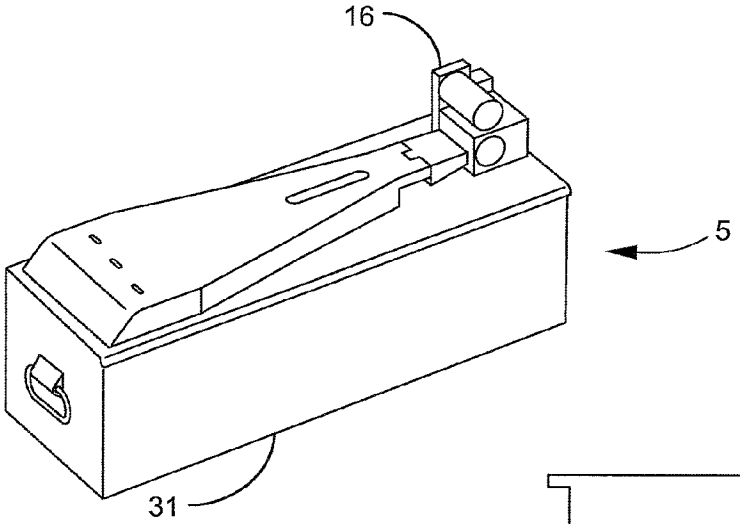
FIG. 4 is a perspective view of a high capacity continuous feed ammunition magazine that is attachable directly to the ammunition mount.

The ammunition mount 4 is adapted to interchangeably hold various ammunition magazines (or boxes), or unique adapters designed to hold one or more ammunition boxes. In one exemplary embodiment the ammunition mount 4 essentially comprises a platform portion 21 for receiving a large ammunition magazine such as the high capacity continuous feed magazine 5 (see FIG. 4), or an ammunition box holder such as ammunition storage cradles 7 (see FIG. 8), and a locking device for releasably securing the ammunition magazine or holder to the platform portion. The ammunition mount extends out from the turret as shown such that the platform portion 21 is cantilevered off the ring. In the depicted embodiment the ammunition mount is positioned directly opposite the gun mount 3, behind the gunner backrest 6, although it should be appreciated other positions or rotational orientations are possible. The ammunition mount 4 may be used, for example, to mount high capacity, continuous feed ammunition magazines, such as the depicted magazine 5 suitable for use with various machine guns. One such magazine designed for use in conjunction with gatling gun 9 is disclosed in pending U.S. patent application Ser. No. 13/525,064 assigned to the assignee of the present application, the entire contents of which are hereby incorporated by reference.

Figure 5:
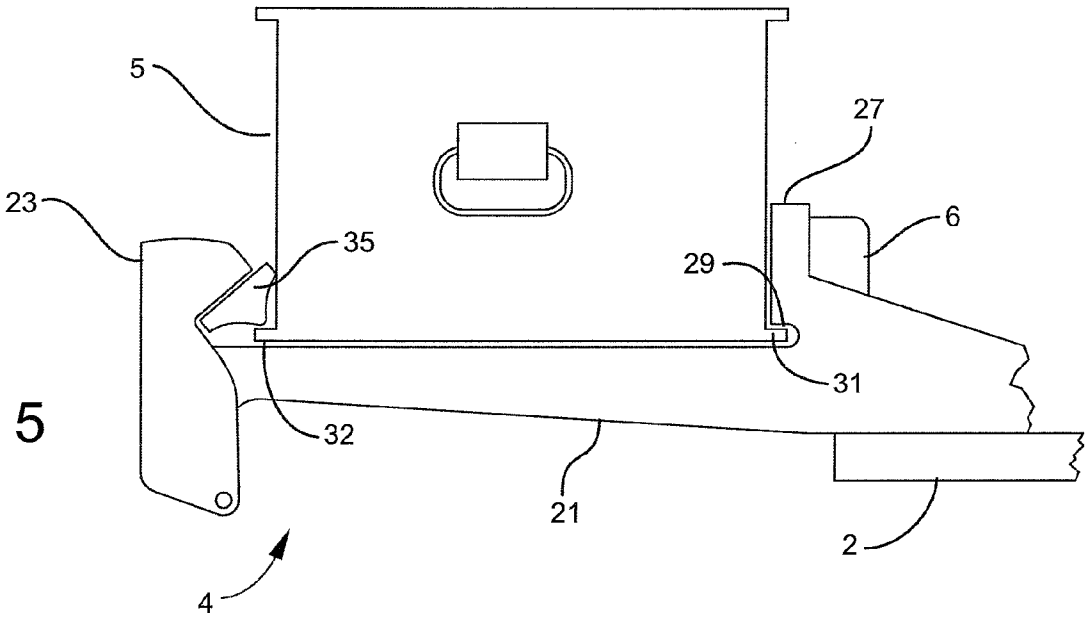
FIG. 5 is a side view of the ammunition magazine of FIG. 4 attached to the ammunition mount.

An ammunition mount 4 may be configured to utilize certain structural design elements typical of large ammunition magazines such as magazine 5. Referring to FIG. 5, an exemplary ammunition mount 4 comprises a wall 27 located at the front of the platform portion 21 and behind the backrest 6. A slot 29 along the bottom of wall 27 receives an elongated flange 31 projecting from a bottom side edge of ammunition magazine 5, thereby trapping that side of the ammunition magazine to the ammunition mount. The projecting flange 31, and a similar flange 32 on the opposite edge of the depicted ammunition box 5, are typical of ammunition boxes such as the M134 magazine. In such constructions the box sides are effectively inset, and the top, bottom and end walls extend beyond the plane of the sides defining the perimeter flanges.

Figure 6:
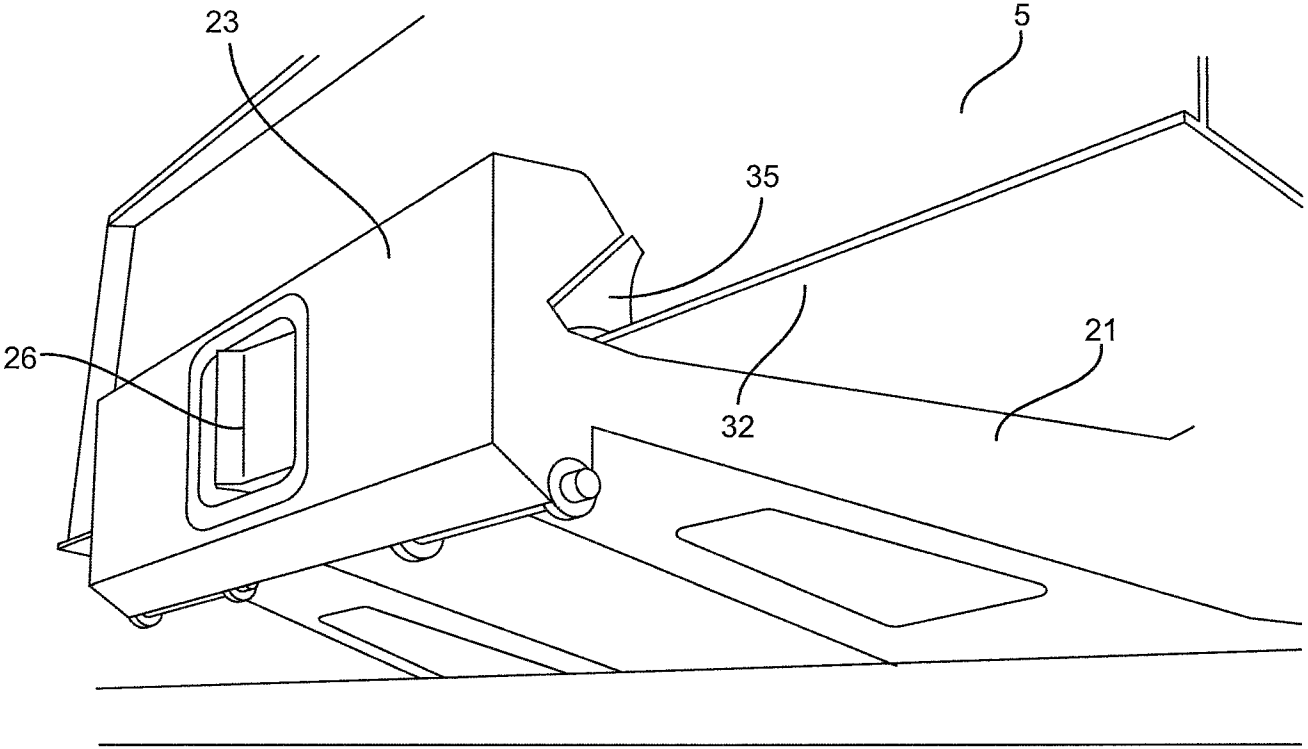
FIG. 6 is a perspective view of a locking device in a closed, locked position securing the ammunition magazine of FIG. 4 to the ammunition mount.
Figure 7:
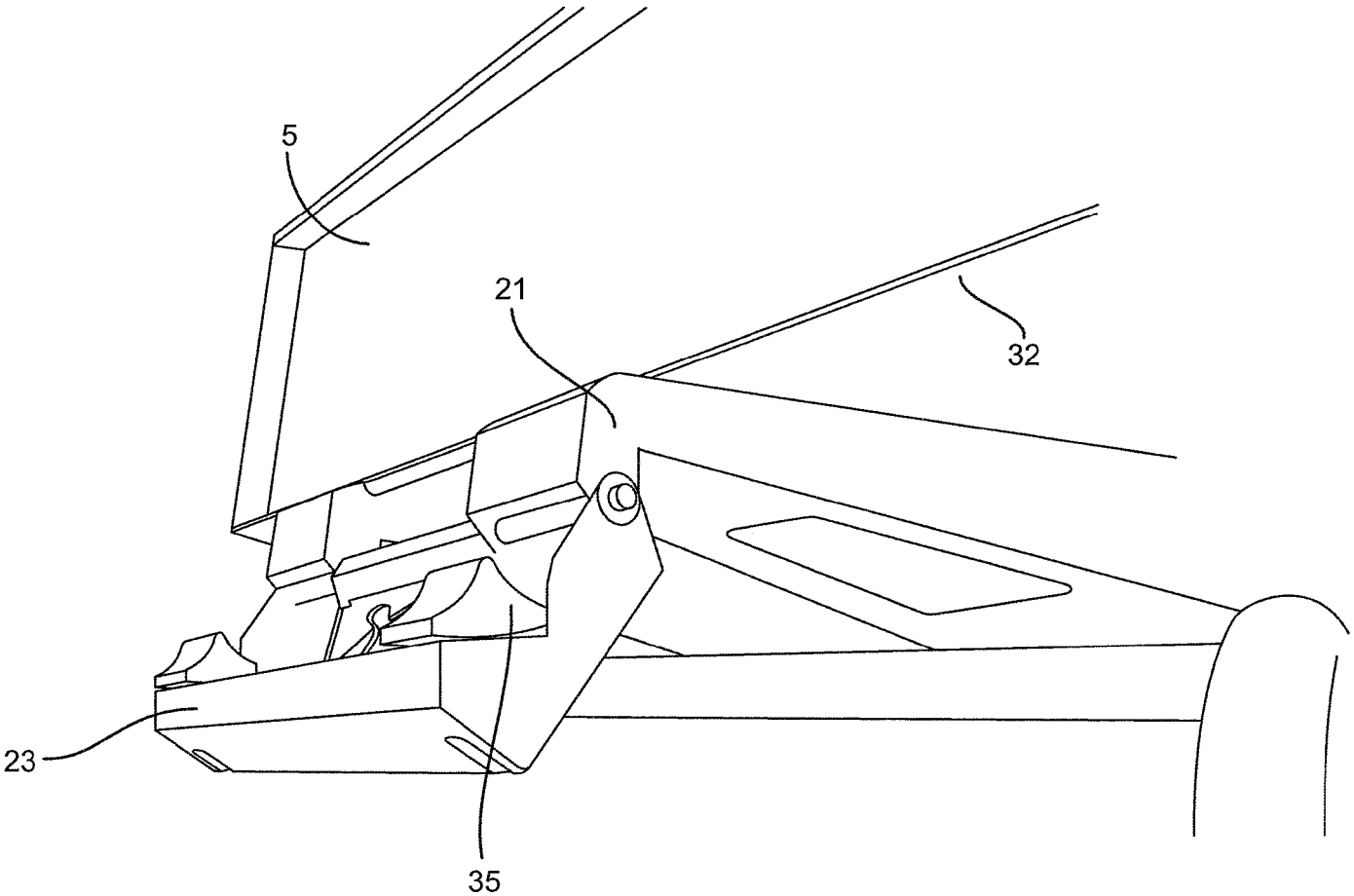
FIGS. 7 and 8 show the locking device of FIG. 6 in the open, unlocked position.
Figure 8:
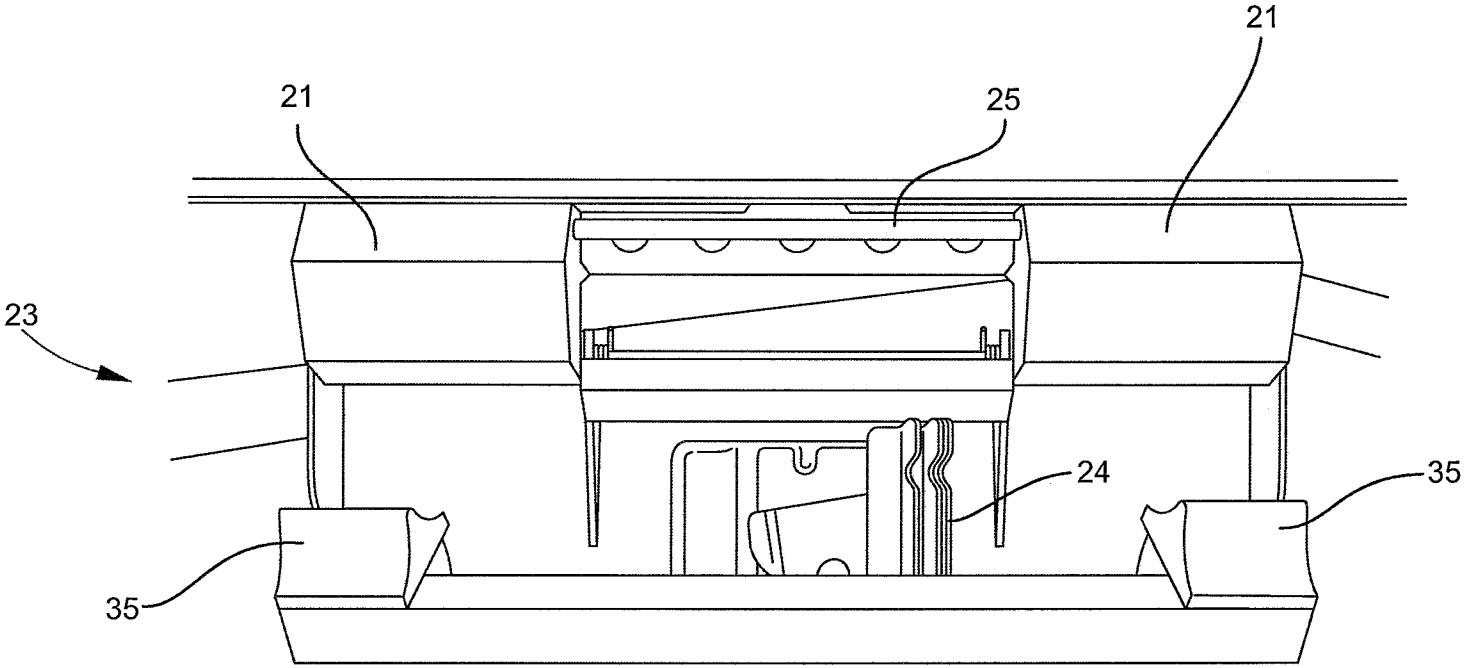

In one exemplary embodiment a locking device in the form of a tailgate 23, is pivotally attached to the back of the ammunition mount 4. The tailgate 23 is movable from a closed position shown in FIGS. 5 and 6 in which it is pivoted up against the back of the ammunition magazine, to an open position shown in FIGS. 7 and 8 in which the tailgate is pivoted down and away from the ammunition magazine. As best seen in FIGS. 7 and 8, the tailgate 23 is pivotally mounted to end portions of the platform portion 21 of mount 4. A latch 24 engages and captures a fixed bar 25 when the tailgate is closed, thereby locking the tailgate in the closed position. The tailgate is opened by pulling on handle 26 to release latch 24 from bar 25. In the closed and locked position, a top portion of the tailgate overhangs flange 32 of ammunition magazine 5, trapping flange 32 and the other side of the ammunition magazine against the ammunition mount. The tailgate 23 may incorporate compliant members such as rubber clamping pads 35 to ensure that a repeatable and even pressure is applied against flange 32 and the side of the magazine. The disclosed tailgate and tailgate latch embodiment are intended to be exemplary, and alternative locking devices and latch mechanisms are possible and within the scope of the present disclosure.

Some weapons such as the previously mentioned M134 gatling gun require a source of electrical power in order to operate. In addition, a high capacity magazine such as the depicted gatling gun magazine 5 may incorporate an electrically powered booster 16 to positively withdraw the ammunition belt from the magazine. The turret 1 of the present disclosure is conveniently adapted to incorporate a suitable power supply for such applications. Referring particularly to FIGS. 1 and 3, a battery tray 41 may be attached to the turret ring 2, or to one side of the ammunition mount 4 as shown. Thus, the battery tray 41 moves with the turret ring, just like the ammunition mount, the gun mount, and a gun attached to the gun mount. Because there is no relative movement between the battery and the connected components like the gun and belt feed booster, there is no movement of or pulling on the interconnecting wiring, as may occur when the source of electrical power is not on the turret. The turret including the ammunition and gun electrical power source if needed may therefore be rotated as an integral unit, in either direction by any amount up to or exceeding 360 degrees of rotation. Referring to FIG. 2, one or more ammunition belt guides 43 may be used to ensure that the belt is not obstructed, and that it approaches the gun from an optimal direction and angle. The guides 43 may be attached directly to the turret ring 2, or to a turret mounted structure such as the ammunition mount or gun mount.

The turret and weapon system of the present disclosure is also compatible with weapons that draw ammunition directly from a magazine that is attached to or plugged into the weapon, such as machine gun 45 shown in FIG. 1. In such cases the turret may be configured without the ammunition guide 43, and without a battery tray 41 if the gun is not electrically powered. In addition, rather than using mount 4 to hold a continuous feed magazine, mount 4 may instead be used to hold an ammunition storage cradle 7.

Figure 10:
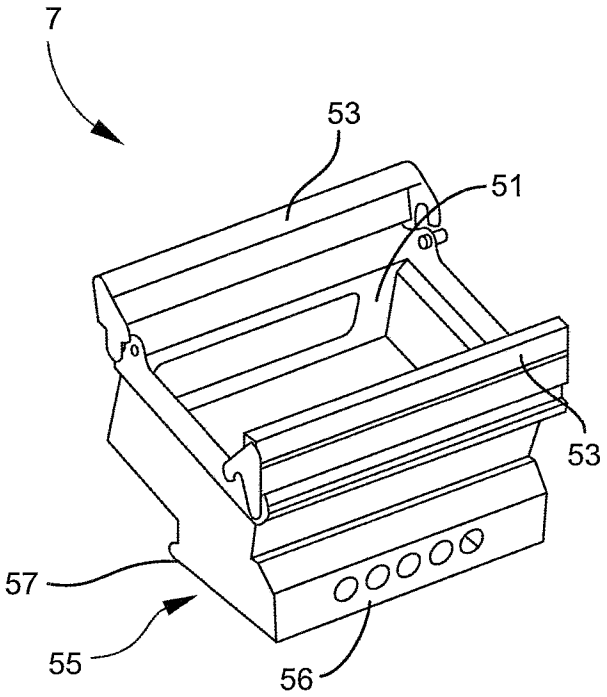
FIGS. 9 and 10 are perspective views of two embodiments of the ammunition storage cradle.
Figure 9:
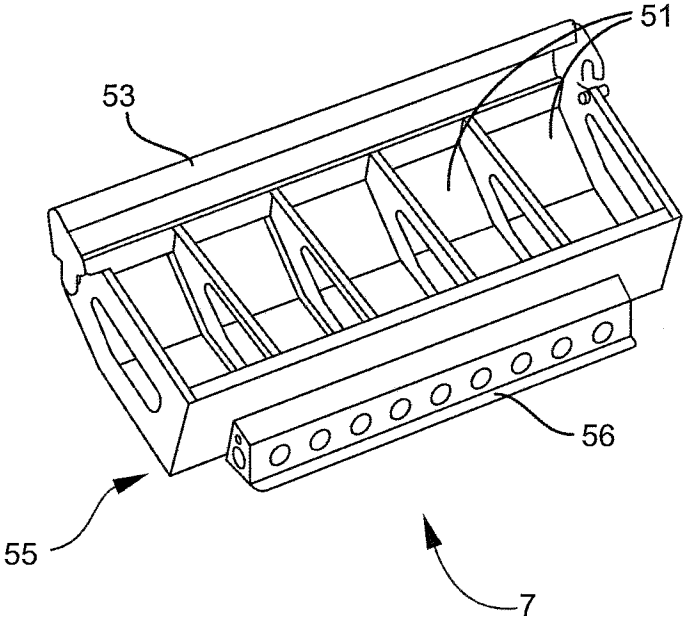

Shown in FIGS. 9 and 10 are two embodiments of storage cradle 7 designed to hold one or more ammunition boxes of the type needed for a particular installed gun. The embodiment of FIG. 10 has one bay 51 for holding one relatively large ammunition box that does not fit directly onto mount 4. The cradle embodiment of FIG. 9 is divided into multiple bays 51 for holding multiple ammunition boxes at once. In both embodiments the ammunition boxes are placed down in the bays 51, and locked in by one or more hinged clamp bars 53. A base portion 55 of the storage cradle incorporates flanges 56, 57 that mimic the spacing and dimensions of flanges 31, 32, of ammunition magazine 5. Thus the storage cradle 7 may be clamped to the ammunition mount 4 in the same manner as the large continuous feed magazine 5. In this way the storage cradle acts as an adapter for mounting ammunition boxes of various sizes and shapes to one configuration of ammunition mount 4. Alternatively, the spacing between the wall 27 and the tailgate 23 may be adjustable to accommodate more than one size of ammunition magazine or storage cradle.

In operation when a gun-mounted magazine runs out of ammunition, the empty box is set aside, and a full magazine is retrieved from the ammunition storage cradle and installed on the gun. Because the ammunition is stored on the ammunition mount within reach of the gunner, no assistance is needed to swap out the ammunition boxes in the manner described. If the gun is changed to one that uses a different size of ammunition magazine, the storage cradle can then be removed and replaced with one of the proper configuration.

Further description and characteristics of a rotatable turret and weapon system in accordance with the present disclosure are provided in "Attachment A" submitted herewith, the entire contents of which are hereby incorporated by reference.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under §112, 6th paragraph is not intended. Additionally, it is not intended that the scope of patent protection afforded the present invention be defined by reading into any claim a limitation found herein that does not explicitly appear in the claim itself.

What is claimed is:

1. A rotatable turret and weapon system, comprising:

a rotatable turret ring atop a gunner station in a supporting structure;

a gun mount at a first location on the turret ring adapted for mounting an automatic weapon accessible to a gunner;

an ammunition mount attached to the turret ring at a second location, the ammunition mount adapted to securely receive at least one ammunition magazine, wherein the ammunition mount, gun mount, and turret ring move as an integral unit; and an integrated source of electrical power suitable for powering an electrically operated automatic weapon, wherein the integrated source of electrical power is a battery mounted to the ammunition mount.

2. The rotatable turret and weapon system of claim 1, wherein the automatic weapon is an electrically operated machine gun, and the ammunition magazine is a high capacity continuous feed magazine designed to dispense an ammunition belt directly to the machine gun.

3. The rotatable turret and weapon system of claim 2, wherein the machine gun is an M134 gatling gun.

4. The rotatable turret and weapon system of claim 1, wherein the ammunition magazine is held in an ammunition storage cradle attached to the ammunition mount.

5. The rotatable turret and weapon system of claim 1, wherein the ammunition mount comprises:

a platform portion extending out away from the turret ring;

a substantially vertical wall at a front portion of the platform portion; and a locking device at a back end of the platform adapted to secure the ammunition box to the platform portion between the locking device and the wall.

6. A rotatable turret and weapon system, comprising:

a rotatable turret ring atop a gunner station in a supporting structure;

a gun mount at a first location on the turret ring adapted for mounting an automatic weapon accessible to a gunner;

an ammunition mount attached to the turret ring at a second location and adapted to securely receive at least one ammunition magazine, the ammunition mount comprising a platform portion extending out away from the turret ring, a substantially vertical wall at a front portion of the platform portion, and a locking device at a back end of the platform adapted to secure the ammunition magazine to the platform portion between the locking device and the wall, wherein the locking device is a tailgate pivotally attached to the platform portion and movable between an open position in which the tailgate is rotated down and away from the ammunition magazine, and a closed position in which the tailgate is rotated up and bearing against the ammunition magazine, and wherein the ammunition mount, gun mount, and turret ring move as an integral unit.

7. The rotatable turret and weapon system of claim 6, further comprising:

a slot at the bottom of the wall adjacent a top surface of the platform, the slot sized to receive a first elongated flange along the bottom edge of one side of the ammunition magazine; and a clamping pad in the tailgate that bears against the ammunition magazine when the tailgate is in the closed position.

8. The rotatable turret and weapon system of claim 7, wherein the clamping pad simultaneously bears against a second elongated flange along the bottom edge of an opposite side of the ammunition magazine.

9. A rotatable turret and weapon system atop a vehicle gunner station, comprising:

a rotatable turret ring;

a gun mount at a first location on to the turret ring;

an ammunition mount at a second location on the turret ring, the ammunition mount adapted for interchangeably securing one of an ammunition magazine or an ammunition box cradle to the turret ring;

a battery powered machine gun attached to the gun mount; and a battery for powering the machine gun attached to the turret ring, wherein the turret ring, ammunition holder, machine gun, and battery move as an integral unit.

10. The rotatable turret and weapon system of claim 9, wherein the ammunition mount comprises a platform, and a locking device that detachably secures the ammunition magazine or ammunition box cradle to the platform.

11. The rotatable turret and weapon system of claim 10, wherein the ammunition magazine or ammunition box cradle have substantially similar mounting features, and wherein the locking device engages the mounting features.

12. The rotatable turret and weapon system of claim 10, wherein the locking device consists of a single latch operable to attach or detach the ammunition magazine or ammunition box cradle from the ammunition mount.

13. The rotatable turret and weapon system of claim 9, wherein the ammunition box cradle comprises a plurality of bays, each bay configured to hold one ammunition box.

14. The rotatable turret and weapon system of claim 13, further comprising a clamp configured to secure each ammunition box in its respective bay.

* * * * *